United States Patent [19]

Blanchard et al.

[11] Patent Number: 4,871,097

[45] Date of Patent: Oct. 3, 1989

[54] DISPLAY HANGER WITH FINGER CLAMPS

[75] Inventors: Russell O. Blanchard, Zeeland; James G. Hansen, Holland, both of Mich.

[73] Assignee: Batts, Inc., Zeeland, Mich.

[21] Appl. No.: 270,242

[22] Filed: Nov. 14, 1988

[51] Int. Cl.[4] ..... A47G 25/30; A47G 25/48

[52] U.S. Cl. ..... 223/85; 223/96; D6/326

[58] Field of Search ..... 223/85, 96, 95; D6/315, D6/326

[56] References Cited

U.S. PATENT DOCUMENTS

| | | | |
|---|---|---|---|
| D. 190,843 | 7/1961 | Levine et al. | 223/96 X |
| D. 191,824 | 11/1961 | Dollins | D6/326 X |
| D. 222,513 | 10/1971 | Hart et al. | D6/315 |
| D. 225,151 | 11/1972 | Hart | D6/326 |
| D. 229,810 | 1/1974 | Wahl | D6/326 |
| D. 281,552 | 12/1985 | Zuckerman et al. | D6/326 X |
| 3,047,196 | 7/1962 | Levine et al. | 223/96 |
| 3,317,096 | 5/1967 | Bissonnette et al. | 223/95 |
| 3,406,883 | 10/1968 | Crane | 223/96 |
| 4,703,878 | 11/1987 | Louw | 223/95 |
| 4,744,496 | 5/1988 | Blanchard et al. | 223/95 |

FOREIGN PATENT DOCUMENTS

| | | | |
|---|---|---|---|
| 971139 | 7/1975 | Canada | 223/96 |

*Primary Examiner*—Robert R. Mackey

*Attorney, Agent, or Firm*—Price, Heneveld, Cooper, DeWitt & Litton

[57] ABSTRACT

A hanger for displaying lightweight garments has an elongated body at each end of which is a dependent U-shaped garment grip in the central opening of which is a downwardly extending slightly resilient finger, the free end of which is spaced a short distance above the bottom of ther central opening in the U-shaped grip. The outer edge of the outer leg of the garment grip is provided with outwardly extending garment grips. The forward face of the finger is provided with forwardly extending projections to engage a garment which is placed against the front face of the hanger wrapped around the end of the garment grip and its end seated against the rear face of the garment grip and in front of the finger so that the finger will press the projections into the garment to positively clamp is to the hanger and hold it against rhe projections on the outer edge of the garment grip.

5 Claims, 3 Drawing Sheets

DISPLAY HANGER WITH FINGER CLAMPS

FIELD OF THE INVENTION

A garment hanger particularly designed for display of such garments as underwear has a garment engaging and holding means at each end which utilizes a U-shaped depending anchor member having a finger occupying the center of the U whereby a garment can be secured to the hanger by passing one end of the garment over one face of the anchor member then around the end of the anchor member and then under the finger so that the finger can press the garment firmly against the anchor member. The anchor member is equipped with projections to provide a positive grip on the garment.

BACKGROUND OF THE INVENTION

The object of the invention is to provide a lightweight, all plastic, inexpensive garment hanger, particularly designed for medium to lightweight articles, such as men's underwear, capable of displaying the garments in such a manner that their construction and design is readily visible. Among the primary objectives of the invention is to provide a hanger which is easy to use and relatively inexpensive. The hanger also provides a means of displaying garments of various sizes utilizing a hanger of a single construction and size. This simplifies the retailers' inventory of display devices, since only a single type is necessary. A further objective of the invention is to provide such a garment holding display device which will not distort, mark or damage the garments even when improperly used or used without proper attention by either customers or store attendants.

BRIEF DESCRIPTION OF THE INVENTION

The invention employs a one-piece, molded plastic hanger, the body of which is elongated and provided with a pair of article holding means, one on each end. The holding means are identical except that one is right and the other left, each consisting of a dependent U-shaped anchor member in the center of which is a dependent resilient finger having a lower free end. The outer edge of the outer leg of the anchor member is equipped with projections for engaging a garment wrapped around the end of the hanger. The front face of the finger is also equipped with forwardly extending projections for gripping a garment which has been wrapped around the end of the hanger and passed around the front of the finger as the garment is seated against the back face of the anchor member. The resilience of the finger is utilized to press the garment against the back side of the anchor member and press the projections on the front face of the finger into the garment to positively secure it to the hanger.

DESCRIPTION OF THE PREFERRED EMBODIMENT

Figure 1:
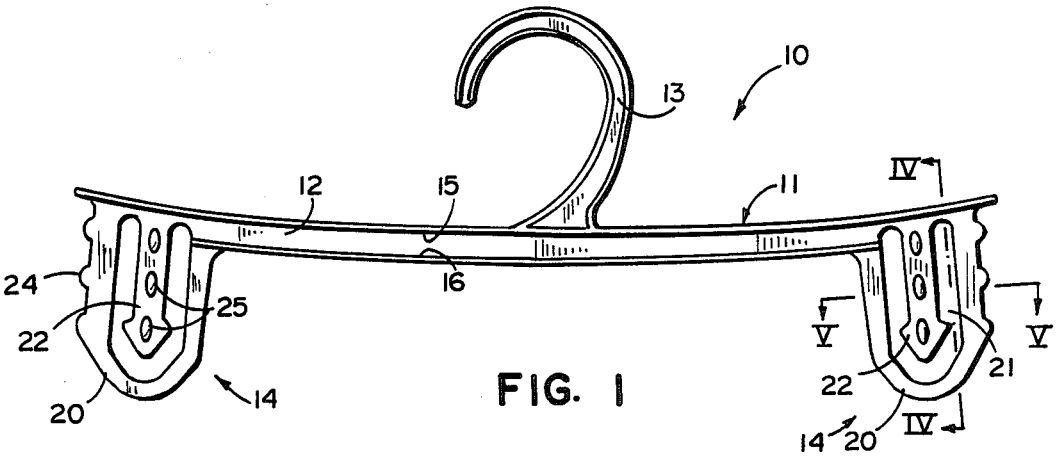
FIG. 1 is a front view of a hanger incorporating this invention.

Referring to FIG. 1, the numeral 10 identifies a hanger having a body 11 which includes an elongated beam member 12 supported at its center by a hook 13. Depending from each end of the body is a garment grip 14. The garment grips at each end are identical except one is right hand and the other left-hand. Therefore, description of one is to be considered as describing both.

Figure 5:
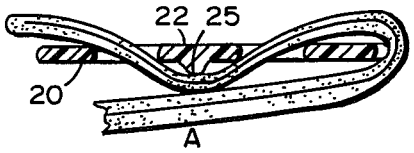
FIG. 5 is a fragmentary sectional elevation view taken along the plane V—V of FIG. 1 with a garment mounted on the hanger.
Figure 8:
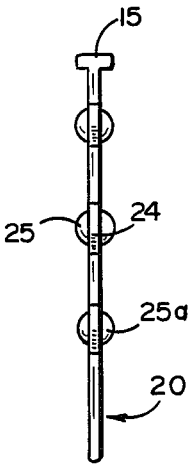
FIG. 8 is an end elevation view taken along the plane VIII—VIII of FIG. 7.

Each garment grip 14 has a depending U-shaped element 20, the upper end of which is integral with the body 11. The element 20 has a central opening 21 in the center of which is a dependent finger 22 having at its free end a head in the general shape of an arrow. The finger 22 is of a size to provide enough clearance for the waistband of a garment to be passed between the finger and the element 20 without the necessity of a severe crimping of the garment (FIG. 5). It will be noted that the opening 21 within the element extends upwardly beyond the bottom edge of the body 1. This is provided to permit the top edge of a garment to be positioned just below the top flange 15 of the beam 12, thus, largely concealing the hanger when in use. This is possible because the U-shaped element 20 is integral with the body and acts as part of the body in the absence of the lower flange 16 of the body. Particularly, is this feasible since the garment type is such that it is relatively lightweight.

Figure 2:
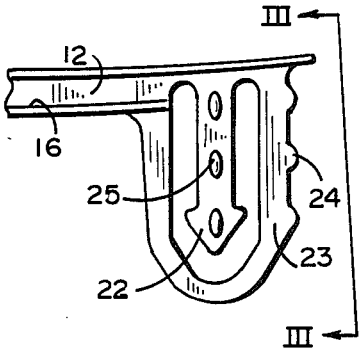
FIG. 2 is an enlarged, fragmentary, front view of one end of the hanger.
Figure 3:
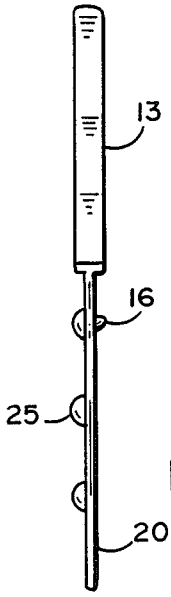
FIG. 3 is an end view of the hanger illustrated in FIG. 1.
Figure 6:
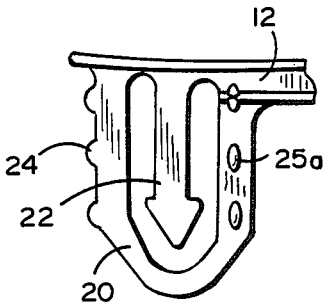
FIG. 6 is a fragmentary rear elevation view of a modified construction for the invention.
Figure 7:
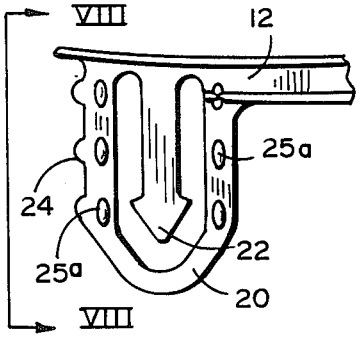
FIG. 7 is a view similar to FIG. 6 of a further modification of the invention.
Figure 4:
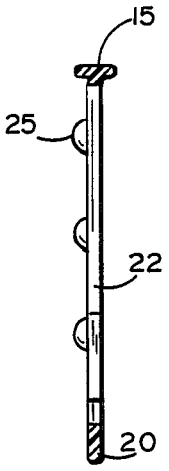
FIG. 4 is a sectional elevation view taken along the plane IV—IV of FIG. 1.
Figure 12:
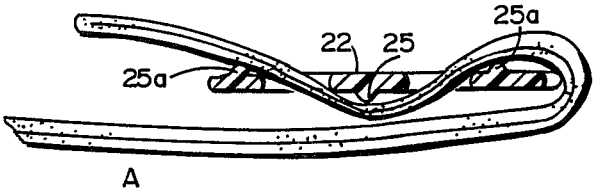
FIG. 12 is a fragmentary sectional view taken along the same plane as FIG. 5, illustrating the FIG. 7 construction with a garment mounted on it.

To provide the hanger with a garment grip to prevent the garments from slipping off the hanger vertically or creeping toward the center, and thus, sag and be displayed in an unattractive manner, the outer end of the outer leg 23 of the element 20 is provided with garment gripping protrusions 24. These protrusions extend outwardly and grip the garment where it is wrapped around the end of the hanger (FIGS. 5 and 12). The front face of the finger 22 is also provided with protrusions 25 which project from the front face of the finger (FIG. 2). The protrusions 24 and 25 are smoothly rounded projections molded into the hanger and of a height sufficient to grip the fabric of the garment even though rounded in contour to avoid snagging. When the garment A is wrapped around the end of the element 20, having been passed in front of the element (FIG. 9) and then behind the element 20 and in front of the finger 22 (FIG. 11), the resilience of the element and the finger will result in the garment being, clamped to the hanger. It will be observed from FIG. 10 that, from the front, the garment, when so mounted, largely conceals the hanger and effectively displays the garment. An enhanced grip can be effected by providing additional protrusions, such as the protrusions 25*a* on the back surface of the outer leg (FIG. 6) or on the back surface of both legs (FIG. 7).

Figure 9:
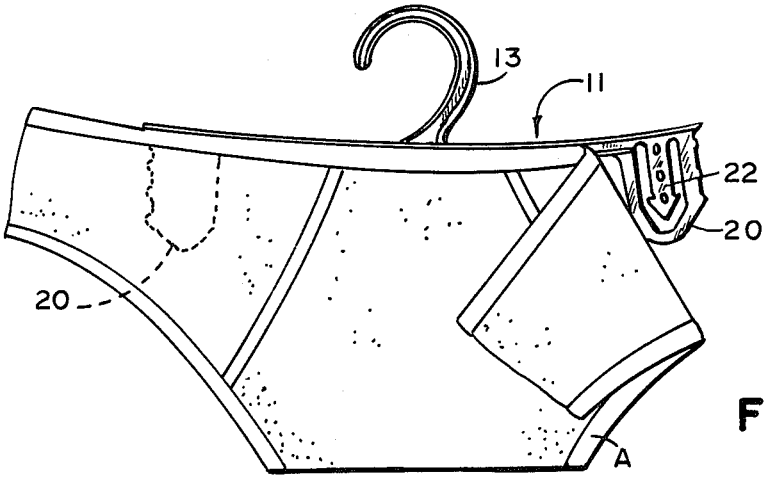
FIG. 9 is a front view of the hanger illustrating a garment being secured to it.
Figure 10:
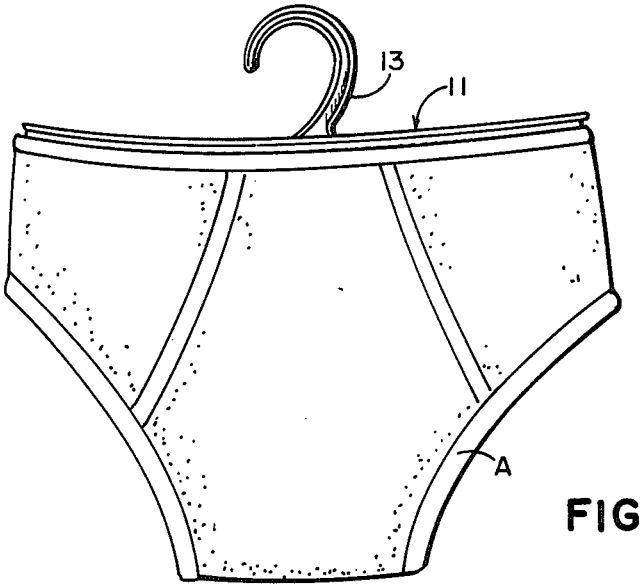
FIG. 10 is a front view of the hanger with the garment secured to it.
Figure 11:
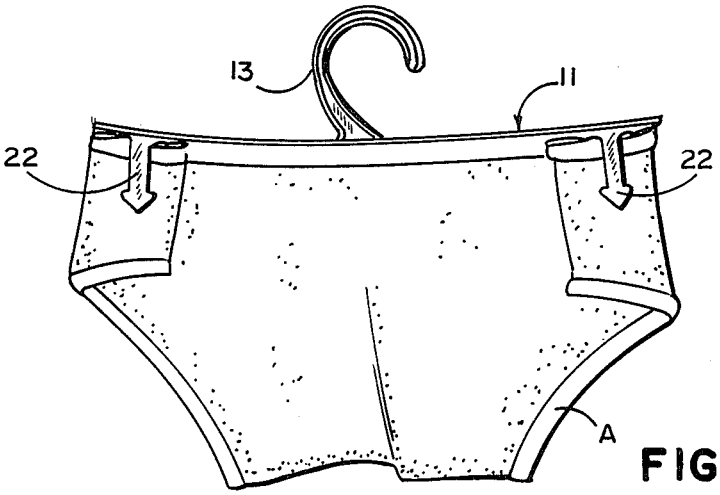
FIG. 11 is a rear view of the hanger with the garment secured to it.

FIGS. 9–11 illustrate the ease and simplicity with which the hanger can be used. It requires a minimum of time and effort to mount a garment on the hanger or to remove it. The hanger's construction provides a positive grip without danger of injury to the garment due to snagging.

The entire hanger can be injection molded as one piece using a relatively simple mold from such materials as polystyrene or polypropylene. Other materials can be utilized so long as they can provide the degree of repeated flexing necessary to mount and remove the garments and yet have and maintain the stiffness required to properly hold the garments while displaying them.

Having disclosed a preferred embodiment of this invention, together with modifications thereof, it will be understood that additional modifications can be made without departing from the principles of the invention. Such modifications are to be considered as included in the hereinafter appended claims, unless these claims by their language expressly state otherwise.

We claim:

1. A hanger for lightweight clothing such as underwear, said hanger having an elongated body and support means at its center by which it can be suspended, said hanger having a depending U-shaped garment anchor member at each end and a depending garment clamping finger centered within each anchor member, the lower end of said finger being adjacent but spaced from the lower end of its associated anchor member, the improvement in said hanger comprising: a plurality of vertically spaced garment engaging first projections extending laterally outwardly in the plane of the hanger body from the outer edge of the outer leg of each anchor member and a plurality of vertically spaced forwardly extending second projection on the front face of each of the clamping fingers, a plurality of vertically spaced third projections extending outwardly from the rear face of the outer one of the legs of each of the anchor members, said first and second projections cooperating to engage and hold a garment extending across the front of the hanger and wrapped around the ends of the anchor members, behind the legs of the anchor members and in front of the fingers with sufficient tension to cause the garment to seat firmly against said first, second and third projections with both the anchor members and fingers concealed from the front behind the garment and the fingers and their projections pressing the garment against said third projections to retain said garment from moving either lengthwise or vertically of the hanger.

2. A hanger as described in claim 1 wherein a plurality of vertically spaced garment engaging projections extend from the rear faces of both of the legs of each of the anchor members.

3. A hanger as described in claim 1 wherein the garment engaging surface of each of the projections is rounded.

4. A hanger as described in claim 1 wherein said body is T-shaped at each end having a top flange and a vertical flange, the openings separating the clamping finger from the sides of the anchor member extending upwardly substantially to the top flange, whereby the top of a garment mounted on the hanger can have its top edge adjacent said top flange.

5. A hanger for lightweight clothing such as underwear, said hanger having an elongated body and support means at its center by which it can be suspended, said elongated body having an I-shaped cross section intermediate the ends thereof with upper and lower flanges separated by a vertical web, said hanger having a depending U-shaped garment anchor member at each end and a depending garment clamping finger within and centered between the legs of each anchor member and with the anchor member forming a U-shaped space between the anchor member and the finger, the lower end of said finger being adjacent but spaced from the lower end of its associated anchor member, the improvement in said hanger comprising: the lower flange of said body terminating at said anchor member and the upper ends of said U-shaped space extending upwardly through said web substantially to the upper one of said flanges; a plurality of vertically spaced garment engaging first projections extending laterally outwardly in the plane of the hanger body from the outer edge of the outer leg of each anchor member and a plurality of vertically spaced forwardly extending second projections on the front face of each of the clamping fingers, said first and second projections cooperating to engage and hold the ends of a garment wrapped around the ends of the anchor members, behind the legs of the anchor members and in front of the fingers with sufficient tension to cause the garment to seat firmly against both the first and second projections, the upper ends of the U-shaped space permitting the top of the garment to be located substantially at the top flange of said body.

* * * * *